United States Patent [19]

Valentine

[11] 4,078,325

[45] Mar. 14, 1978

[54] DISPLAY DEVICE

[76] Inventor: Michael J. Valentine, 113 Burleigh Dr., Ithaca, N.Y. 14850

[21] Appl. No.: 726,355

[22] Filed: Sep. 24, 1976

[51] Int. Cl.[2] ..... G09F 01/04

[52] U.S. Cl. ..... 40/388; 35/28.5; 35/50; 40/530

[58] Field of Search ..... 40/102, 96, 97, 104.11, 40/104.03, 104.05; 35/28.3, 28.5, 55, 54, 50; 281/49, 21 R, 23

[56] References Cited

U.S. PATENT DOCUMENTS

| | | | |
|---|---|---|---|
| Re. 22,716 | 2/1946 | Macey | 35/50 |
| Re. 26,395 | 5/1968 | Schneider | 40/102 |
| 720,646 | 2/1903 | Westfahl | 35/28.5 |
| 2,937,566 | 5/1960 | Ward et al. | 40/102 X |

*Primary Examiner*—John F. Pitrelli
*Attorney, Agent, or Firm*—Martin LuKacher

[57] ABSTRACT

A device is described which is useful for displaying objects such as paint color chips wherein a nonrigid elongated carrier, such as a tape, has the objects to be displayed attached thereto in spaced relationship along the carrier. The objects are disposed in pairs on opposite sides of the carrier. The pairs are spaced from each other to form gaps. Tabs, which may be inscribed with names designating the objects, are attached to the tape in the gaps. These tabs are smaller than the gaps so as to define fold regions. The device may be folded in the manner of an accordian such that the objects may be stacked, one on top of the other, with the tabs remaining upright along the sides of the stack.

6 Claims, 5 Drawing Figures

DISPLAY DEVICE

The present invention relates to marketing devices and particularly to a device for displaying or carrying objects.

The invention is especially suitable for the use in connection with the display of samples, such as paint color chips. The device may also be used as a holder for various objects and also as a toy or plaything.

In carrying out different marketing programs it is often necessary to display a large number of items. For example, in the sale of paint, painted furniture or machines, or painting services, it is generally necessary to show the customer a large number of available colors so that the customer can make his or her selection. These colors are often on chips of the material to be painted, such as for example, metal plates in the case of painted metal goods. Each display object, for example each paint chip, must be tagged with its own name or number. There are problems therefore in organizing, transporting, and mounting the objects for display. It is also advantageous from a marketing viewpoint not to contaminate the display, as by covering the object with data, regarding the number or name thereof.

It is a feature of this invention to provide a device which enables the display of object, such as paint chips and other samples, which may readily be handled and yet displays the objects and the relevant data respecting the objects in a manner which is informative and pleasing to the customer. The invention also affords a display device which can be folded into a small volume and yet may be readily extended to full size when in use.

It is another feature of this invention to provide a display device which is interesting to the customer so as to make it desirable to him or her to handle and use the display, and to become familiar with the goods. An ancillary feature of the invention, which is provided by virtue of its interesting manipulative characteristics, is that it may be used as a toy or plaything.

It is therefor an object of the invention to provide an improved device for holding and carrying objects.

It is a further object of the present invention to provide a device for displaying objects such as paint chips which can be folded to occupy a small volume and yet readily displays the chips and data such as the names and numbers associated therewith.

Briefly described a device embodying the invention uses an elongated carrier made of non-rigid material. A plurality of pairs of rigid members such as for example objects to be displayed are attached to the carrier at proposed locations on opposite sides thereof. These locations are spaced from each other along the carrier to define gaps therebetween. A plurality of pairs of rigid tabs which may provide tags designating the members by name or number are attached to the carrier in the gaps so as to provide sufficient space between the members and the tabs to form fold regions. The tape may be folded at these fold regions much like an accordian so as to stack the members on top of each other; the tabs remaining upright along the sides of the stack.

Other objects, features and advantages of the invention will become more apparent from a reading of the following specification in connection with the accompanying drawings in which FIG. 1 is a plan view of a display device embodying the invention;

Figure 1:
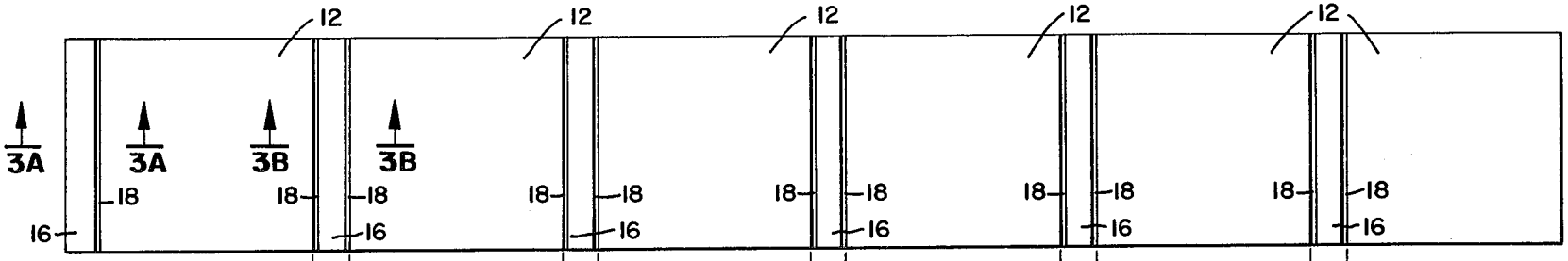

Referring to the drawings, and particularly to FIGS. 1, 2, 3A & 3B which illustrate the device in open or unfolded condition, there is shown a carrier 10. This carrier is an elongated strip, such as a tape of non-rigid material. A plastic material such as vinyl may suitable be used for the carrier 10. It has been found that the vinyl, dual adhesive coated carpet tape manufactured by the Minnesota Mining and Manufacturing Company of St. Paul, Minnesota, can be used in implementing the display device. This tape, for example, may be 1¼ inches in width.

The objects to be displayed in this illustrative embodiment of the invention are metal paint chips. These paint chips are illustrated as the rectangular members 12 which are attached to the tape on opposite sides thereof. Pairs 13 of these members 12 are opposed to each other. Each pair 13 of members 12 is spaced from the pair adjacent thereto so as to form a gap 14 therebetween. The members 12 in the case of the illustrative paint chips are rectangular in shape and have widths equal to the width of the carrier tape 10. It may be desirable for the width of the members to be greater than the width of the carrier tape. It will be appreciated of course that other shapes, such as circles or oblongs or the like may be used. Where an adhesive coated tape such as the above-described carpet tape is used, it is desirable to cover the tape which is not covered by other parts of the display device, with a non-rigid material or to otherwise remove the adhesive from the uncovered regions of the tape. This will prevent exposure of tacky material. Tabs 16 in the form of strips which extend widthwise across the tape are located in the gaps 14. Tabs are desirably used as tags on which may be placed suitable indicia, such as the name or number of the object (e.g., the name or catalog number of the paint color), on the exposed surface of the adjacent member 12. The tabs themselves may suitably be of rigid material, cellulose acetate, with a matte or opaque finish being suitable. In the event that a tape carrier 10 which is not coated with adhesive on both sides is used, the surface of the members 12 and the tabs 16 may be coated with a suitable adhesive and attached to the carrier 10.

The tabs 16 are desirably smaller in height than the members 12. The height of the tabs should be sufficient to maintain their rigidity. The tabs are also spaced from the members to define regions 18 which act as fold lines or hinges.

As shown in FIG. 3, the device may be folded so as to occupy a small volume at these fold regions 18. When folded the carrier will form an angle of at least 90° such that the members 12 come into stacked relationship on top of each other. The tabs 16 stand upright along the edges of the stack of members such that the display data may readily be observed.

Figure 2:
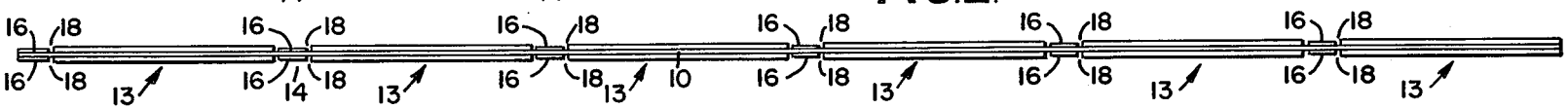
FIG. 2 is a front view of the device shown in FIG. 1.
Figure 4:
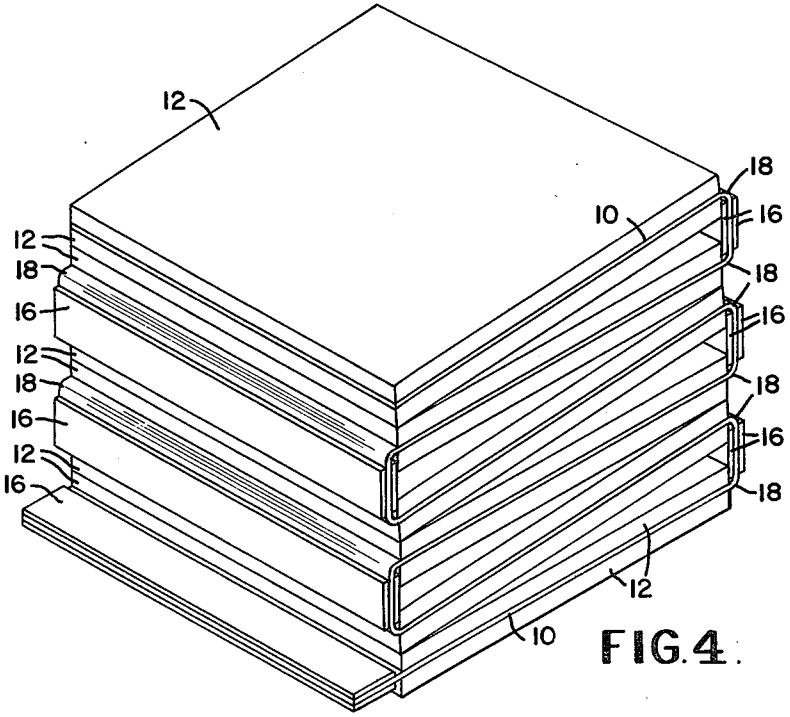
FIG. 4 is a perspective view showing the device shown in FIGS. 1 to 3 when folded.
Figure 3A:
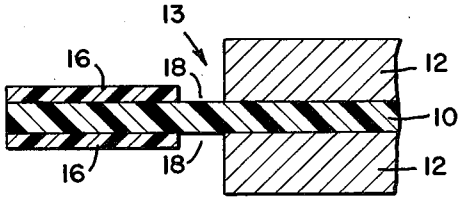
FIGS. 3A and 3B are sectional views of the device shown in FIG. 4 taken along lines 3A—3A & 3B—3B thereof shown in FIG. 4.
Figure 3B:
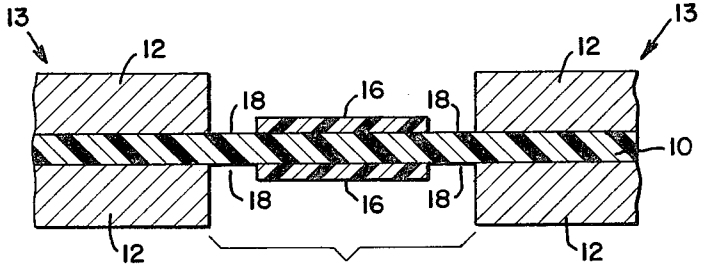

It has been found that the device is interesting to handle. It may be held at the top and allowed to drop by gravity to an extended condition (as shown in FIGS. 1 and 2). The device may readily be re-folded and may be stored individually or in small boxes, or containers.

From the foregoing description it will be apparent that there has been provided an improved display device. While a preferred embodiment of the device has been described, variations and modifications thereof within the scope of the invention will undoubtedly suggest themselves to those skilled in the art. Accordingly, the foregoing description should be taken as illustrative and not in any limiting sense.

What is claimed is:

1. A display device comprising (a) an elongated carrier made of non-rigid material, (b) a plurality of pairs of rigid members, (c) the members of each of said pairs being attached to said carrier at opposed locations on opposite sides of said carrier, said locations being spaced from each other along said carrier to define gaps therebetween, (d) a plurality of pairs of rigid tabs, said tabs having lengths less than the lengths of said gaps, said tabs being of much smaller length than said members, said tabs also being of smaller height than said members, (e) the tabs of each of said pairs of tabs being attached to said carrier in said gaps on opposite sides of said carrier to define along said carrier, between each of said member pairs and said tab pairs, fold regions by means of which said device can be folded like an accordian to bring said members into stacked relationship, said fold regions being of sufficient length to provide folds of at least 90° when said device is folded to bring said members into stacked relationship, said tabs being in upright position when said device is folded and being adapted to have indicia thereon relating to said members.

2. The invention as set forth in claim 1 wherein said carrier is a tape.

3. The invention as set forth in claim 2 wherein said tape has an adhesive coating on the opposite sides thereof for attaching said members and tabs thereto.

4. The invention as set forth in claim 3 wherein said members are plates and said tabs are strips, said plates and strips having widths which are no less than the width of said tape.

5. The invention as set forth in claim 4 wherein said plates are metal and said tabs are of cellulose acetate.

6. The invention as set forth in claim 4 wherein said plates are painted in different color and said indicia are labels designating said colors.

* * * * *